US007618242B2

(12) United States Patent
Higuchi et al.

(10) Patent No.: US 7,618,242 B2
(45) Date of Patent: Nov. 17, 2009

(54) HERMETIC SEALED COMPRESSOR

(75) Inventors: Masahide Higuchi, Kusatsu (JP); Eiji Kumakura, Kusatsu (JP); Takashi Hirouchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 613 days.

(21) Appl. No.: 10/478,422

(22) PCT Filed: Feb. 25, 2003

(86) PCT No.: PCT/JP03/02090

§ 371 (c)(1),
(2), (4) Date: Nov. 21, 2003

(87) PCT Pub. No.: WO03/074871

PCT Pub. Date: Sep. 12, 2003

(65) Prior Publication Data

US 2004/0219037 A1 Nov. 4, 2004

(30) Foreign Application Priority Data

Mar. 7, 2002 (JP) ..... 2002-061665

(51) Int. Cl.
*F04B 17/00* (2006.01)
*F04B 35/04* (2006.01)

(52) U.S. Cl. ..... 417/410.3; 417/410.1; 417/902; 418/63

(58) Field of Classification Search ..... 417/410.1, 417/410.3; 418/63
See application file for complete search history.

(56) References Cited

U.S. PATENT DOCUMENTS 4,214,950 A * 7/1980 Balandin et al. ..... 376/288
5,322,420 A 6/1994 Yannascoli
5,382,143 A * 1/1995 Nakamura et al. ..... 418/55.1
5,531,574 A * 7/1996 Honma ..... 417/415
5,564,916 A * 10/1996 Yamamoto et al. ..... 418/1
5,674,056 A * 10/1997 Yamamoto et al. ..... 417/366
5,782,622 A 7/1998 Ozu et al.
5,842,846 A * 12/1998 Fukuoka et al. ..... 418/63
6,158,980 A * 12/2000 Tsumagari et al. ..... 417/366
6,193,485 B1 * 2/2001 Ueda et al. ..... 418/55.1
6,283,729 B1 * 9/2001 Makino et al. ..... 417/410.3
6,517,328 B2 * 2/2003 Makino et al. ..... 417/410.1

FOREIGN PATENT DOCUMENTS

JP 61-171888 8/1986
JP 62-135877 U 8/1987

(Continued)

OTHER PUBLICATIONS

USPTO translation of Ozu, JP 61-171888.*

*Primary Examiner*—Devon C Kramer
*Assistant Examiner*—Patrick Hamo
(74) *Attorney, Agent, or Firm*—Global IP Counselors

(57) ABSTRACT

A front head of a cylinder and a mounting plate are tightly fixed to each other. The mounting plate is welded to a casing. The mounting plate is made of steel containing 2.0% or less of carbon therein. Furthermore, a stator core of a compressor motor is welded to the casing. A hermetic sealed compressor is configured in a high-pressure domed type. A supercritical fluid is used as an operating fluid.

9 Claims, 6 Drawing Sheets

FOREIGN PATENT DOCUMENTS

| | | | |
|---|---|---|---|
| JP | 62-156183 | U | 10/1987 |
| JP | 63-18190 | | 1/1988 |
| JP | 63-166692 | | 10/1988 |
| JP | 05-47449 | U | 6/1993 |
| JP | 6-159274 | | 6/1994 |
| JP | 06-213185 | A | 8/1994 |
| JP | 07-180680 | A | 7/1995 |
| JP | 09-112463 | A | 5/1997 |
| JP | 10-318169 | | 12/1998 |
| JP | 11-182433 | A | 7/1999 |
| JP | 2001-280264 | | 10/2001 |
| JP | 2003-120534 | A | 4/2003 |

* cited by examiner

HERMETIC SEALED COMPRESSOR

TECHNICAL FIELD

The present invention relates to a hermetic sealed compressor and, more particularly, to measures to enhance the reliability of operation for fixing a compressing element or a drive motor for the compressing element to the inside of a casing.

BACKGROUND ART

As disclosed in, for example, Japanese Patent Application Laid-open No. 159,274/1994, there has been conventionally known a hermetic sealed compressor, in which a compressing element and a drive motor are contained inside of a casing of a welding structure in a sealed manner. Such a hermetic sealed compressor has a high reliability since an operating fluid cannot leak, and further, there is no danger of intrusion or the like of water when the operating fluid is compressed. Therefore, the hermetic sealed compressor is provided in a refrigerant circuit of a freezer for use in an air conditioner or the like.

The compressing element in the above-described hermetic sealed compressor is configured such that it is driven by the drive motor so as to compress the operating fluid. The compressing element is provided with, for example, a cylinder and a rotary piston.

Problems to be Solved

However, the cylinder in the compressing element has been generally molded with a casting, thereby arising a problem of insufficient welding strength between the casing and the compressing element. That is to say, cast iron has properties such as low ductility and fragility. Furthermore, the welding of a casting is likely to lead to welding deficiency for the reason that a crack is liable to occur by the combination of a residual stress at the time of casting and a residual stress at the time of welding.

Moreover, the drive motor has been generally fixed inside of the casing by shrink-fitting, thereby raising a problem of insufficient welding strength between the casing and the drive motor. In other words, if the casing is expansively deformed by an inside pressure, an interference with the drive motor is reduced, thereby leading to the insufficient welding strength.

In particular, in the case where, for example, fluid having a very high pressure such as carbon dioxide is used as the operating fluid, the expansive deformation of the casing caused by the inside pressure becomes large, thereby deteriorating the welding of the compressing element or inducing positional shift of the drive motor. Therefore, there has arisen a problem of degradation of the reliability of the fixing of contained parts.

The present invention has been accomplished in an attempt to solve the above problems observed in the prior art. An object of the present invention is to enhance the reliability of the fixing of the contained parts in the hermetic sealed compressor.

DISCLOSURE OF THE INVENTION

In order to achieve the above-described object, according to the present invention, a compressing element (20) is fixed to a casing (10) via a fixing member (40) made of steel containing 2.0% or less of carbon therein, or a stator core (34) of a drive motor (30) is welded to a casing (10).

Specifically, according to a first invention, on the precondition of a hermetic sealed compressor characterized by comprising a casing (10) and a compressing element (20) which compresses an operating fluid and is accomodated inside a casing (10), the compressing element (20) is fixed to a fixing member (40) which is made of steel containing 2.0% or less of carbon therein and is welded to the casing (10).

Furthermore, according to a second invention, the fixing member (40) is configured independently of the compressing element (20) and the casing (10) in the first invention.

Moreover, according to a third invention, the compressing element (20) includes a main body (22), a cover (23) forming the upper surface of a compression chamber (26) and a bottom (24) forming the lower surface of the compression chamber (26); and the fixing member (40) is welded to the casing (10) while at least any one of the main body (22), the cover (23) and the bottom (24) of the compressing element (20) is tightly fixed to the fixing member (40) in the second invention.

Additionally, according to a fourth invention, the compressing element (20) is provided with a cylinder (21), an swing piston (25), which swings inside of the cylinder (21), and a bush (66) for supporting the swing piston (25), the cylinder (21) having a bush hole (65), into which the bush (66) is inserted, formed therein; and a bush penetrating hole (46), which communicates with the bush hole (65) and allows a lubricant staying inside of the casing (10) to flow through the bush hole (65), is formed in the fixing member (40) in the second invention.

In addition, according to a fifth invention, the fixing member (40) is formed into an annular shape in such a manner as to allow the compressing element (20) to be fitted and inserted thereinto; and an oil returning hole (47) for allowing the lubricant to flow down is formed in the fixing member (40), the opening area of the oil returning hole (47) being set to 50% or more with respect to the bottom area of the fixing member (40) in the third invention.

Furthermore, according to a sixth invention, a welding hole (28) is formed in the casing (10) in a manner corresponding to the fixing member (40); and the fixing member (40) is welded to the casing (10) via the welding hole (28) in the first or second invention.

Moreover, according to a seventh invention, the casing (10) incorporates therein a drive motor (30) provided with a stator (32) having coils wound around a stator core (34) and a rotor (33) rotatably housed inside of the stator (32) and drivingly connected to the compressing element (20), thus driving the compressing element (20), the stator core (34) of the drive motor (30) being welded to the casing (10) in the first or second invention.

Additionally, according to an eighth invention, on the precondition of a hermetic sealed compressor characterized by comprising a casing (10) and a drive motor (30) housed in the casing (10) and provided with a stator (32) having coils wound around a stator core (34) and a rotor (33) rotatably housed inside of the stator (32) and drivingly connected to a compressing element (20), thereby driving the compressing element (20), the stator core (34) of the drive motor (30) is welded to the casing (10).

In addition, according to a ninth invention, a welding hole (38) is formed in the casing (10) in a manner corresponding to the stator core (34), the stator core (34) being welded to the casing (10) via the welding hole (38) in the eighth invention.

Furthermore, according to a tenth invention, oil returning portions (83), each having an area of 5% or more with respect to a bottom area at the inside of the casing (10), are formed in the stator core (34) in the eighth invention.

Moreover, according to an eleventh invention, the oil returning portions (83) in the stator core (34) are formed adjacently to portions at which the outer peripheral surface of the stator core (34) is brought into contact with the casing (10) in the tenth invention.

Additionally, according to a twelfth invention, the operating fluid discharged from the compressing element (20) is configured in a high-pressure domed type in such a manner as to fill the inside of the casing (10) in the first or eighth invention.

In addition, according to a thirteenth invention, the hermetic sealed compressor is connected to a refrigerant circuit for performing a freezing cycle and configured in such a manner as to compress the operating fluid above its critical pressure in the first or eighth invention.

Function

That is to say, according to the first invention, the compressing element (20) for compressing the operating fluid is fixed to the fixing member (40) which is made of steel containing 2.0% or less of carbon therein and is welded to the casing (10). Consequently, in the case where the casing (10) is deformed with an increase in inside pressure of the casing (10), it is possible to prevent any welding deficiency such as de-welding at a welding portion, for example, a welding portion of a casting. As a result, it is possible to enhance the reliability with respect to the welding in fixing the compressing element (20).

Furthermore, according to the second invention, the fixing member (40) is configured independently of the compressing element (20) and the casing (10) in the first invention, and therefore, the compressing element (20) and the casing (10) are fixed to each other via the fixing member (40). Consequently, even in the case where the welding portion of the compressing element (20) is constituted of, for example, a casting, like in the prior art, it is possible to enhance the reliability with respect to the welding in fixing the compressing element (20).

Moreover, according to the third invention, the fixing member (40) is fixed to the casing (10) by welding while at least any one of the main body (22), the cover (23) and the bottom (24) of the compressing element (20) is tightly fixed to the fixing member (40) in the second invention. Consequently, even in the case where the welding portion of the compressing element (20) is constituted of, for example, a casting, like in the prior art, it is possible to enhance the reliability of the welding fixture to the casing (10), and further, to securely fix the compressing element (20) to the fixing member (40).

Additionally, according to the fourth invention, the compressing element (20) is provided with the cylinder (21), the swing piston (25) and the bush (66), the cylinder (21) having the bush hole (65) formed therein in the second invention. And further, the bush penetrating hole (46) communicating with the bush hole (65) is formed in the fixing member (40). Consequently, the lubricant staying inside of the casing (10) can be allowed to easily flow into the bush hole (65) through the bush penetrating hole (46). As a result, even in the case where a highly viscous lubricant, for example, is used, the lubricant can be allowed to securely flow into the bush hole (65).

In addition, according to the fifth invention, the compressing element (20) is fitted and inserted into the annular fixing member (40); and the oil returning hole (47) is formed in the fixing member (40) in the third invention. And further, the opening area of the oil returning hole (47) is set to 50% or more with respect to the bottom area of the fixing member (40). Consequently, it is possible to readily remove the lubricant remaining on the fixing member (40). As a result, even in the case where a highly viscous lubricant, for example, is used, the lubricant staying inside of the casing (10) can be securely returned to an oil reservoir.

Furthermore, according to the sixth invention, the fixing member (40) is welded to the casing (10) via the welding hole (28) formed in a manner corresponding to the fixing member (40) in the first or second invention. Consequently, it is possible to readily and securely fix the compressing element (20).

Moreover, according to the seventh or eighth invention, the stator core (34) of the drive motor (30) for driving the compressing element (20) is welded to the casing (10). Even if the casing (10) is expansively deformed by an increase in inside pressure, the stator core (34) can be prevented from being positionally shifted. Additionally, since the stator core (34) is generally made of steel, the stator core (34) can be securely welded to the casing (10). As a result, it is possible to prevent any degradation of an air gap between the stator core (34) and the rotor (33) or any contact of the stator core (34) with the rotor (33), thereby enhancing the reliability of the compressor (1).

In addition, according to the ninth invention, the stator core (34) is welded to the casing (10) via the welding hole (38) in a manner corresponding to the stator core (34) in the eighth invention. Consequently, it is possible to readily and securely fix the drive motor (30).

Furthermore, according to the tenth invention, the oil returning portions (83) are formed in the stator core (34), wherein each of the oil returning portions (83) has an area of 5% or more with respect to the bottom area at the inside of the casing (10) in the eighth invention. Consequently, the lubricant staying inside of the casing (10) can be readily returned to the oil reservoir through the oil returning portions (83) in the stator core (34). Even in the case where a highly viscous lubricant is used, the lubricant can be securely returned to the oil reservoir.

Moreover, according to the eleventh invention, the oil returning portions (83) in the stator core (34) are formed adjacently to the portions at which the outer peripheral surface of the stator core (34) is brought into contact with the casing (10) in the tenth invention. Consequently, it is possible to secure the portion to be welded to the casing (10) while to securely return the lubricant adhering to the inner wall of the casing (10) to the oil reservoir.

Additionally, according to the twelfth invention, the operating fluid discharged from the compressing element (20) is configured in the high-pressure domed type in such a manner as to fill the inside of the casing (10) in the first or eighth invention. Consequently, since the discharged fluid having the increased pressure is filled into the casing (10), the pressure inside of the casing (10) is increased, thereby largely deforming the casing (10). However, the compressing element (20) is fixed via the fixing member (40), which is made of steel containing 2.0% or less of carbon therein and welded to the casing (10), so that it is possible to prevent any welding deficiency such as de-welding in, for example, welding of a casting even in the case of such large deformation.

In addition, according to the thirteenth invention, the operating fluid is compressed above its critical pressure in the first or eighth invention. Consequently, the pressure becomes very high inside of the hermetic sealed compressor (1). However, the compressing element (20) is fixed via the fixing member (40), which is made of steel containing 2.0% or less of carbon therein and welded to the casing (10), so that it is possible to prevent any welding deficiency such as de-welding in, for example, welding of a casting even in the case that the casing (10) is expansively deformed.

Effects of the Invention

As described above, according to the first invention, in the case where the casing (10) is deformed with an increase in inside pressure of the casing (10), it is possible to prevent any welding deficiency such as de-welding at the welding portion, for example, the welding portion of the casting. As a result, it is possible to enhance the reliability with respect to the welding in fixing the compressing element (20).

Furthermore, according to the second invention, even in the case where the welding portion of the compressing element (20) is constituted of, for example, the casting, like in the prior art, it is possible to enhance the reliability with respect to the welding in fixing the compressing element (20).

Moreover, according to the third invention, even in the case where the welding portion of the compressing element (20) is constituted of, for example, the casting, like in the prior art, it is possible to enhance the reliability of the welding fixture to the casing (10), and further, to securely fix the compressing element (20) to the fixing member (40).

Additionally, according to the fourth invention, the lubricant staying inside of the casing (10) can be allowed to easily flow into the bush hole (65) through the bush penetrating hole (46). As a result, even in the case where the highly viscous lubricant, for example, is used, the lubricant can be allowed to securely flow into the bush hole (65).

In addition, according to the fifth invention, even in the case where the highly viscous lubricant, for example, is used, the lubricant staying inside of the casing (10) can be securely returned to the oil reservoir.

Furthermore, according to the sixth invention, the fixing member (40) is welded to the casing (10) via the welding hole (28) formed in a manner corresponding to the fixing member (40) in the first or second invention, thus making it possible to readily and securely fix the compressing element (20).

Moreover, according to the seventh or eighth invention, even if the casing (10) is expansively deformed by the increase in inside pressure, the stator core (34) can be prevented from being positionally shifted, and the stator core (34) can be securely fixed to the casing (10). As a result, it is possible to prevent any degradation of the air gap between the stator core (34) and the rotor (33) or any contact of the stator core (34) with the rotor (33), thereby enhancing the reliability of the compressor (1).

Additionally, according to the ninth invention, the stator core (34) is welded to the casing (10) via the welding hole (38) in a manner corresponding to the stator core (34), thereby making it possible to readily and securely weld and fix the drive motor (30).

In addition, according to the tenth invention, the lubricant staying inside of the casing (10) can be readily returned to the oil reservoir through the oil returning portions (83) in the stator core (34). Even in the case where the highly viscous lubricant is used, the lubricant can be securely returned to the oil reservoir.

Furthermore, according to the eleventh invention, it is possible to secure the portion to be welded to the casing (10) while to securely return the lubricant adhering to the inner wall of the casing (10) to the oil reservoir.

Moreover, according to the twelfth invention, even in the case where the discharged fluid having the increased pressure is filled into the casing (10), which is thus expansively deformed, it is possible to prevent any welding deficiency such as de-welding at the welded portion, for example, by welding of the casting.

Additionally, according to the thirteenth invention, even in the case where the operating fluid is compressed above its critical pressure, it is possible to prevent any welding deficiency such as de-welding at the welded portion, for example, by welding of the casting.

BRIEF DESCRIPTION OF THE DRAWINGS

FIGS. 3A and 3B are views showing the configuration of a front head and a mounting plate, wherein FIG. 3A is a plan view and FIG. 3B is a cross-sectional view taken along a line III-III of FIG. 3A;

FIGS. 4A and 4B are views showing the configuration of the mounting plate, wherein FIG. 4A is a plan view and FIG. 3B is a cross-sectional view taken along a line IV-IV of FIG. 4A;

BEST MODES FOR CARRYING OUT THE INVENTION

Preferred embodiments according to the present invention will be described below in reference to the accompanying drawings.

Figure 1:
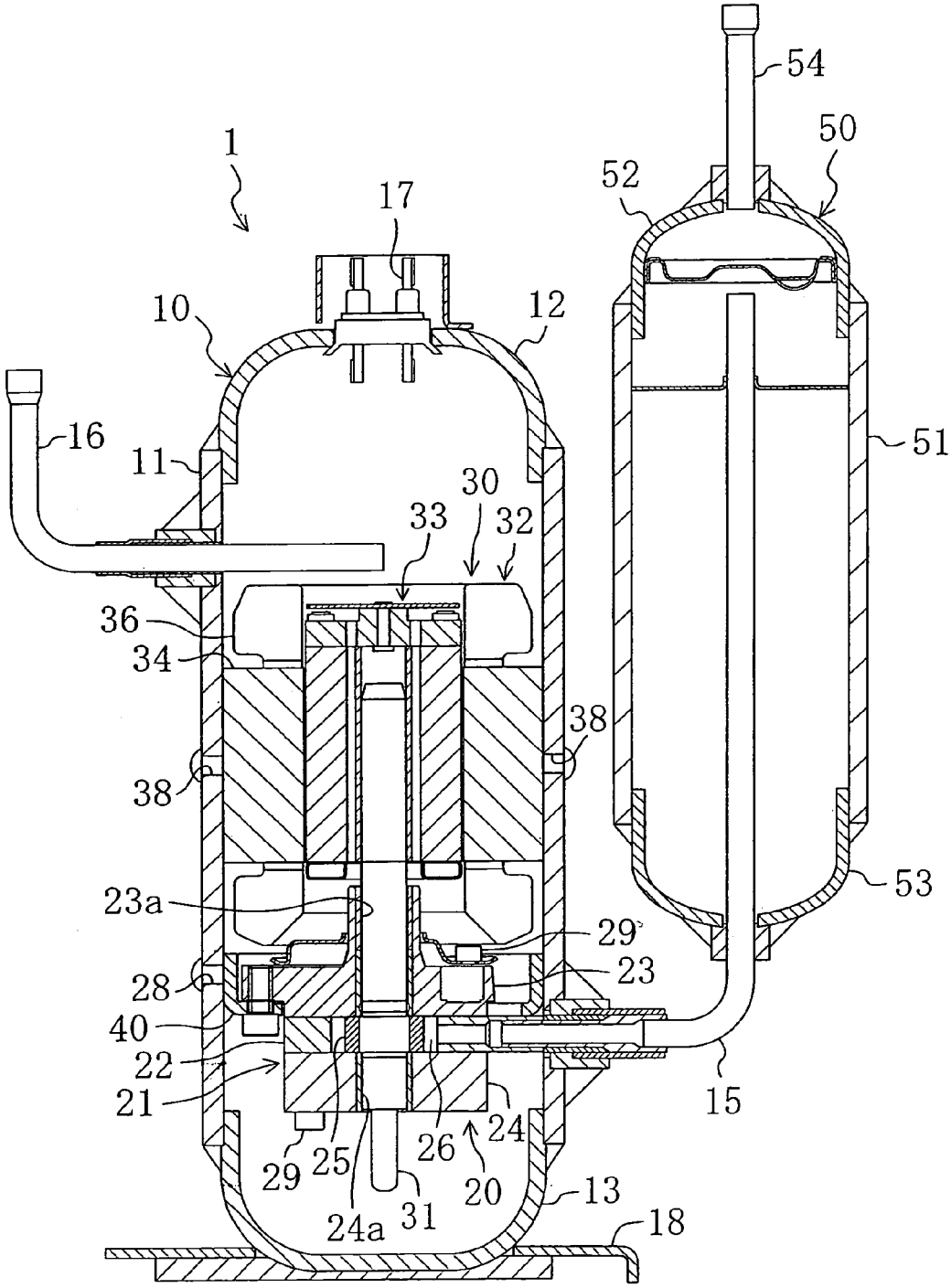
FIG. 1 is a cross-sectional view showing the entire configuration of a hermetic sealed compressor in a preferred embodiment.

A hermetic sealed compressor (1) in the present preferred embodiment is exemplified by a rotary compressor of an swing piston type. As shown in FIG. 1, in the hermetic sealed compressor (1), a compressing element (20) for compressing a refrigerant serving as an operating fluid and a compressor motor (30) functioning as a drive motor arranged above the compressing element (20) are contained inside of a casing (10). The hermetic sealed compressor (1) is configured in a fully sealed manner and is formed into a so-called high-pressure domed type. Carbon dioxide ($CO_2$), for example, is used as the refrigerant. The compressor (1) is connected to a refrigerant circuit, not shown, for performing a freezing cycle in an air conditioner or the like, and thus, is configured for compressing the refrigerant at its critical pressure or higher. Here, the high pressure of this freezing cycle is set to, for example, 13.7 MPa.

The casing (10) is constituted of a cylindrical drum (11) and a pair of cup-shaped mirror plates (12) and (13) welded and fixed to the upper and lower portions of the drum (11), respectively. In the drum (11) of the casing (10), there are provided a suction pipe (15) penetrating the drum (11) and a discharge pipe (16) penetrating the drum (11) at a portion above a connecting portion of the suction pipe (15) and allowing the inside and outside of the casing (10) to communicate with each other. In the meantime, in the upper mirror plate (12), there is provided a terminal (17) for supplying electric power to the compressor motor (30) in connection with an outside power source, not shown. Furthermore, an oil reservoir, not shown, for reserving therein a predetermined quantity of a lubricant is formed at the lower portion of the casing (10). In the hermetic sealed compressor (1) in the present preferred embodiment, a highly viscous lubricant is used as the operating fluid so as to secure an oil film at a sliding portion in consideration of a bearing load since the refrigerant such as carbon dioxide whose high pressure becomes very high is compressed. Moreover, a bracket (18) for supporting the compressor (1) is disposed at the lower end of the lower mirror plate (13).

The compressing element (20) is provided with a cylinder (21) and a swing (25) serving as an swing piston which swings inside of the cylinder (21), and it is arranged at the lower portion of the casing (10). The cylinder (21) includes a cylinder body (22) serving as a main body, a front head (23) serving as a cover and a rear head (24) serving as a bottom. The cylinder body (22) is formed into a cylindrical shape, and is arranged coaxially with the drum (11) of the casing (10). The front head (23) is disposed at the upper end of the cylinder body (22); in contrast, the rear head (24) is disposed at the lower end of the cylinder body (22). The cylinder body (22), the front head (23) and the rear head (24) are tightened via a bolt (29) as an integral assembly. Here, the cylinder body (22), the front head (23) and the rear head (24) each are made of a casting.

The above-described cylinder (21) is fixed to the drum (11) of the casing (10) via a mounting plate (40) serving as a fixing member. Specifically, the mounting plate (40) is tightly fixed to the front head (23) via a bolt (42), and is secured to the drum (11) of the casing (10) by welding. The mounting plate (40) and the drum (11) of the casing (10) are welded and fixed to each other by forming a fusing portion by the effect of the flow of molten metal from the outside of the casing (10) through a welding hole (28) penetrating the drum (11) of the casing (10). The details of the mounting plate (40) will be described later.

In the cylinder (21), a compression chamber (26) is defined by the inner circumferential surface of the cylinder body (22), the lower end of the front head (23), the upper end of the rear head (24) and the outer peripheral surface of the swing (25).

At the front head (23) and the rear head (24) are formed shaft holes (23*a*) and (24*a*) vertically penetrating the center, respectively. Into the shaft holes (23*a*) and (24*a*), a drive shaft (31) is rotatably inserted. That is to say, the drive shaft (31) is arranged in such a manner as to vertically extend at the center inside of the casing (10), and therefore, vertically penetrates the front head (23), the compression chamber (26) and the rear head (24) in the cylinder (21).

In the meantime, the compressor motor (30) is provided with a stator (32) and a rotor (33), and is arranged above the compressing element (20).

The stator (32) includes a cylindrical stator core (34) and three-phase coils disposed in the stator core (34). The end of each of the coils in the axial direction projects from the end of the stator core (34) in the shaft center direction, and thus, is formed into a coil end (36). The stator (32) is configured in such a manner as to generate a rotating magnetic field by the energization of each of the coils. The details of the stator core (34) will be described later. A permanent magnet, not shown, is fitted into the rotor (33). The rotor (33) can be rotated inside of the stator (32), and further, the drive shaft (31) is fitted into the rotor (33), so that the rotor (33) is drivingly connected to the compressing element (20).

The stator core (34) is shrink-fitted to the drum (11) of the casing (10), and further, is welded and fixed to the drum (11). the stator core (34) and the drum (11) of the casing (10) are welded and fixed to each other by forming a fusing portion by the effect of the flow of molten metal from the outside of the casing (10) through a welding hole (38) penetrating the drum (11) of the casing (10).

The rotor (33) is rotated by the energization of the compressor motor (30) via a terminal (17), and thus, the drive shaft (31) is rotated, so that the rotating drive force is applied to the compressing element (20), thereby driving the compressing element (20).

Although not shown, a centrifugal pump and an oil supply path are disposed in the drive shaft (31). The centrifugal pump is disposed at the lower end of the drive shaft (31), and is configured to pump up the lubricant reserved in the lower portion inside of the casing (10) according to the rotation of the drive shaft (31). The oil supply path vertically extends inside of the drive shaft (31), and further, communicates with oil supply ports formed at sliding portions in such a manner as to supply the lubricant pumped up by the centrifugal pump to the sliding portions.

To the above-described hermetic sealed compressor (1) is connected an accumulator (50) via the suction pipe (15). The accumulator (50) is configured into a sealed container, which is long in a vertical direction, constituted of a drum member (51) and cup-shaped upper and lower members (52) and (53) welded to the upper and lower ends of the drum member (51), respectively. In the accumulator (50), the suction pipe (15) is inserted into the lower end of the lower member (53); in contrast, the lower end of a return pipe (54) is inserted into the upper end of the upper member (52). The return pipe (54) is adapted to introduce the refrigerant circulating in the refrigerant circuit to the accumulator (50), and therefore, it is configured such that the upper end thereof can be freely connected to a pipeline, not shown, which constitutes the refrigerant circuit. The suction pipe (15) extends inside of the sealed container up to the upper height of the drum member (51). Furthermore, the accumulator (50) is configured in such a manner as to separate a liquid refrigerant from the refrigerant which flows through the return pipe (54).

Figure 2:
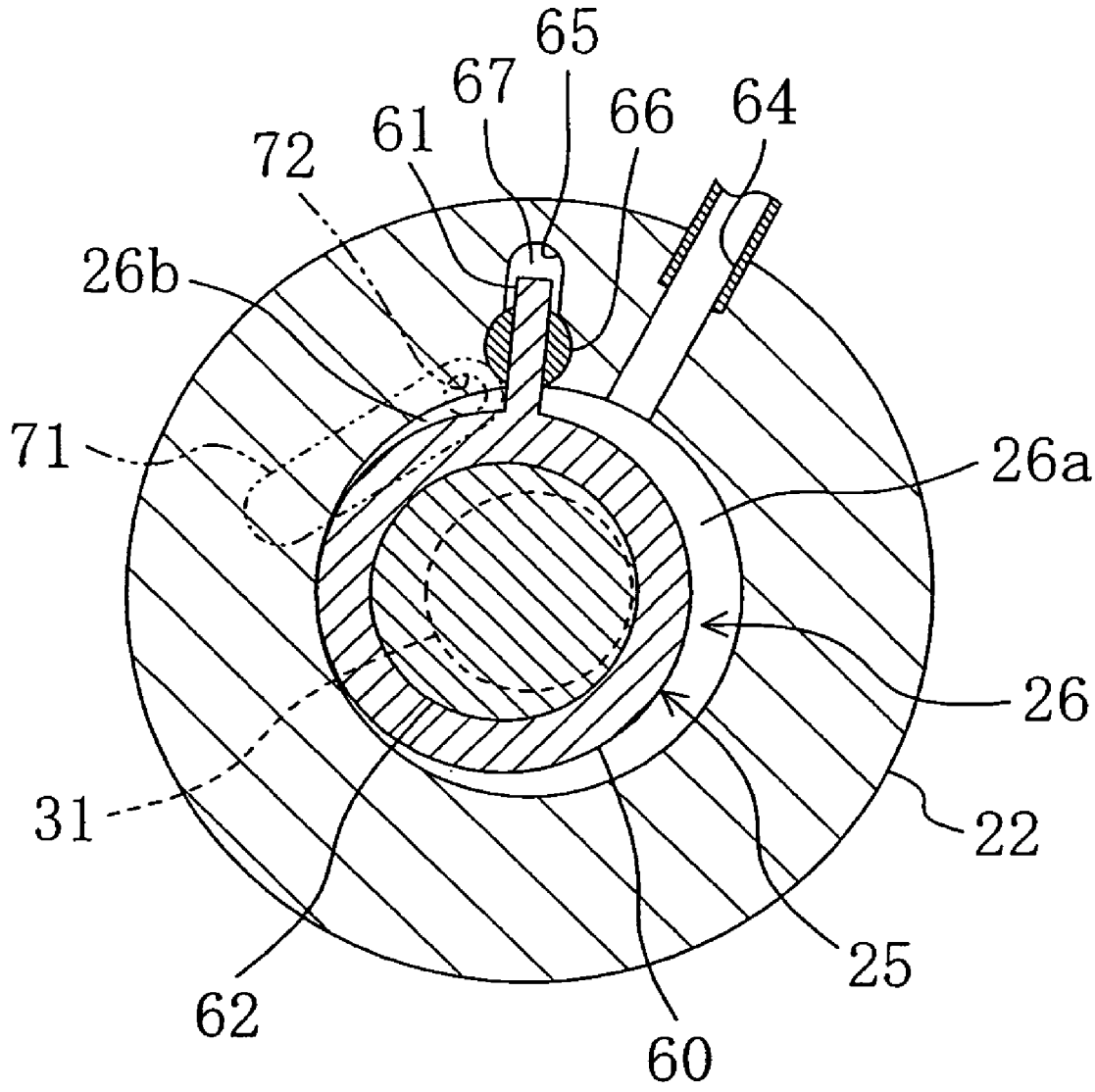
FIG. 2 is a cross-sectional view showing the configuration of a cylinder body and a swing.

As shown in FIG. 2, the cylinder body (22) contains the swing (25) therein, and further, is provided with a suction passage (64) and a bush hole (65).

The swing (25) is constituted of a cylindrical rotor (60) and a rectangular blade (61) in an integral fashion, wherein the rotor (60) is located in the compression chamber (26). An eccentric portion (62) formed integrally with the drive shaft (31) is fitted into the rotor (60), so as to turnably support the rotor (60). Moreover, the rotor (60) is located such that a part of the outer peripheral surface thereof is brought into contact with the inner circumferential surface of the cylinder body (22) via the oil film of the lubricant. The swing (25) divides the compression chamber (26) into a low-pressure chamber (26*a*) and a high-pressure chamber (26*b*).

The suction passage (64) is formed in such a manner as to penetrate the outer peripheral surface and inner circumferential surface of the cylinder body (22) in a radial direction. Furthermore, the suction passage (64) is opened at the inside end thereof to the compression chamber (26), to thus freely communicate with the low-pressure chamber (26*a*). Into the suction passage (64) is fitted the suction pipe (15) inserted into the drum (11) of the casing (10).

The bush hole (65) is bored at the inner circumferential surface of the cylinder body (22) in the vicinity of the suction passage (64), and further, is formed from the upper surface of the cylinder body (22) toward the lower surface of the cylinder body (22). In the bush hole (65) are oscillatably disposed a pair of bushes (66), each of which is formed into a half-moon shape in cross section. The bushes (66) are located near the inner circumferential surface of the cylinder body (22) in the bush hole (65). A back space (67) is formed on the outer peripheral side of the bushes (66) in the bush hole (65). The blade (61) of the swing (25) is inserted between the bushes (66), and thus, is supported by both of the bushes (66) in such a manner as to freely advance or retreat. Upon rotation of the drive shaft (31), the swing (25) is swingd on both of the swing bushes (66) serving as an swing center.

As shown in FIGS. 3A, 3B, 4A and 4B, the mounting plate (40) is provided with an annular bottom surface (44) and a side surface 45 erected at the peripheral edge of the bottom surface (44), and is formed into a U shape in vertical cross section. The front head (23) of the compressing element (20) is inserted in such a manner as to close an opening inside of the bottom surface (44). The front head (23) is located at the lower end thereof in a state flush with the lower end at the bottom surface (44) of the mounting plate (40).

The mounting plate (40) is made of steel containing 2.0% by mass percentage or less of carbon therein, and its side surface 45 constitutes a fixing member welded to the drum (11) of the casing (10). In other words, the compressing element (20) is fixed to the mounting plate (40), which is made of steel containing 2.0% by mass percentage or less of carbon therein and serves as the fixing member welded to the casing (10).

At the inside end of the bottom surface (44) of the mounting plate (40) is formed a bottom recess (46) recessed outward in a radial direction. The bottom recess (46) is formed from the upper surface of the bottom surface (44) toward the lower surface of the bottom surface (44) at a position right above the bush hole (65) of the cylinder body (22), thereby allowing a space defined inside of the casing (10) and the back space (67) of the bush hole (65) in the cylinder body (22) to communicate with each other. That is to say, the bottom recess (46) is adapted to allow the lubricant staying inside of the casing (10) to flow into the bush hole (65), and therefore, it constitutes a bush penetrating hole communicating with the bush hole (65).

Moreover, at the bottom surface (44) of the mounting plate (40), there are formed an oil returning hole (47) for returning oil and through holes (41), through which the bolt (42) tightened to the front head (23) is inserted. The number of through holes (41) is three. The oil returning hole (47) consists of a plurality of slots (47*a*), which are arranged at substantially equal intervals in a circumferential direction and penetrate the bottom surface (44) upward, each of the slots (47*a*) being formed into an elliptic shape as viewed on a plane. The opening area of the oil returning hole (47) is set to 50% or more with respect to the bottom area of the bottom surface (44) of the mounting plate (40). In other words, the total area of the opening areas of the slots (47*a*) is set to 50% or more with respect to the bottom area of the bottom surface (44).

Figure 3A:
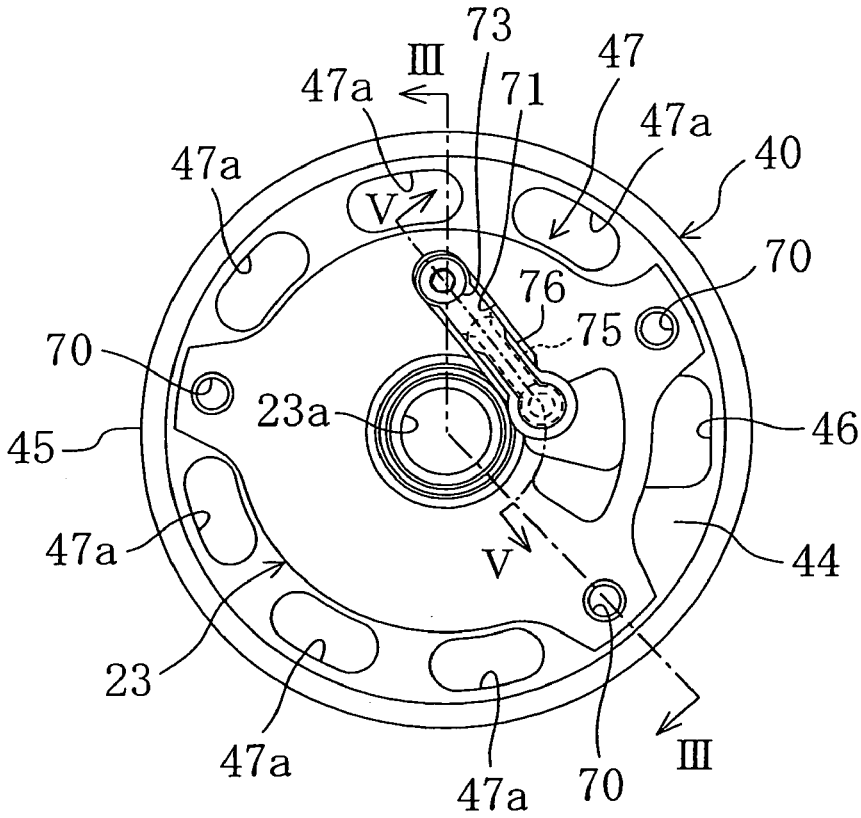
Figure 3B:
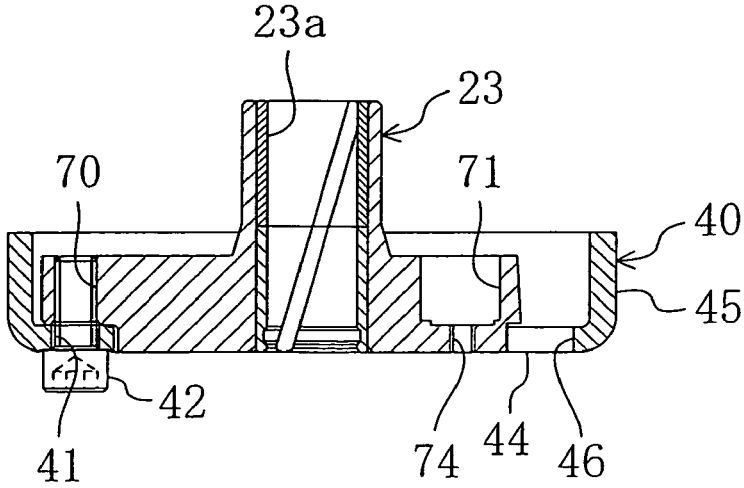
Figure 4A:
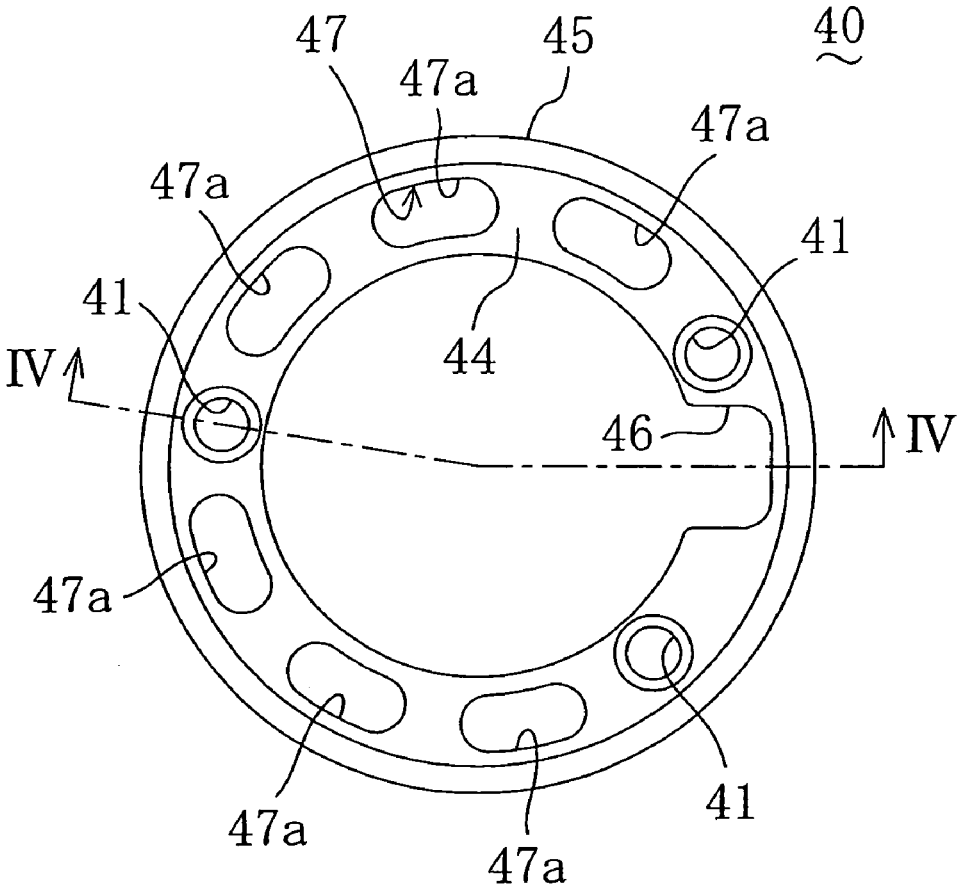
Figure 4B:
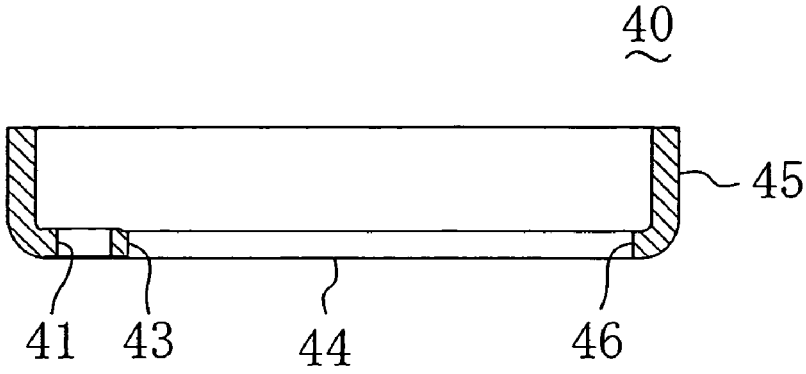

As shown in FIGS. 3A and 3B, a plurality of tightening holes (70) and a cutout recess (71) are formed at the front head (23). The tightening holes (70) are formed so that the bolt (42) are screwed together with the mounting plate (40), and therefore, are formed at a position corresponding to the through hole (41) of the mounting plate (40). The cutout recess (71) is formed into a substantially elliptic shape, as viewed on a plane, at the upper surface of the front head (23).

Figure 5:
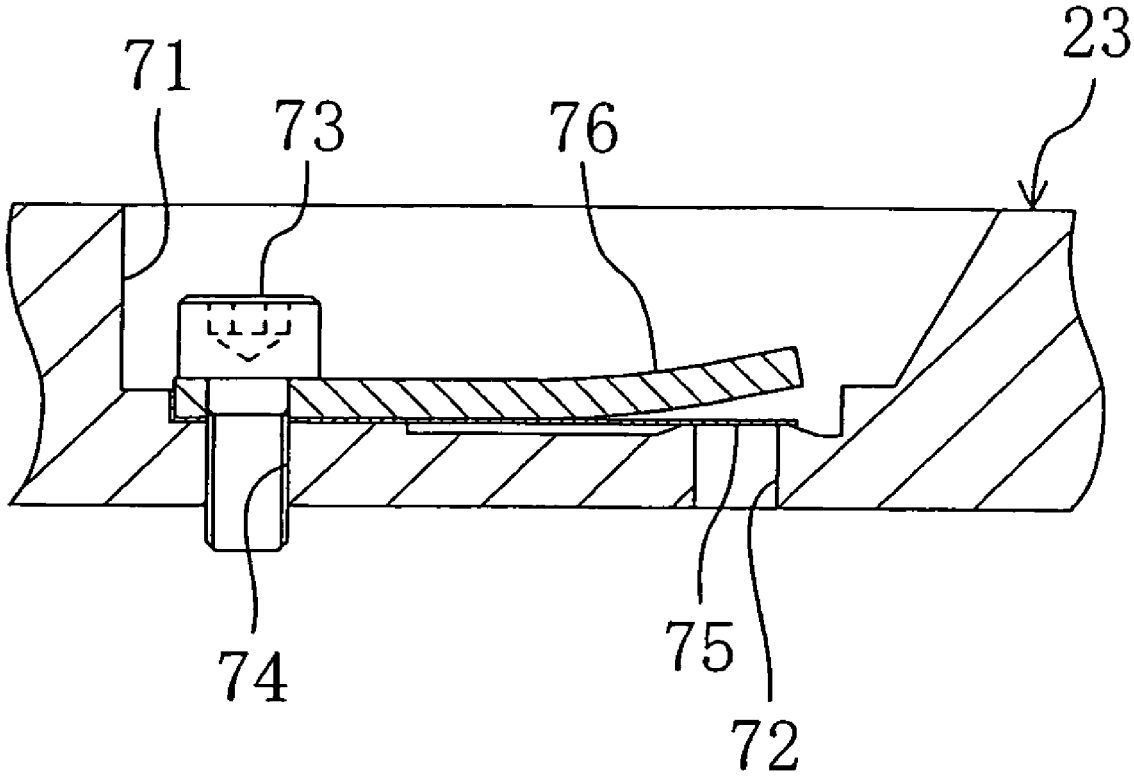
FIG. 5 is a cross-sectional view taken along a line V-V of FIG. 3A.

Additionally, at the front head (23) are formed a discharge hole (72) for discharging the high-pressure refrigerant staying inside of the compression chamber (26) and a tightening hole (74) for tightening a bolt (73) continuously to the cutout recess (71) at the tip end thereof or the base end thereof, respectively, as shown in FIG. 5. The discharge hole (72) is formed at a position adjacent to the inner circumferential surface of the cylinder body (22) and corresponding to the vicinity of the bush hole (65) in such a manner as to penetrate from the lower end of the front head (23) toward the cutout recess (71), thus communicating with the inside of the casing (10). Furthermore, the discharge hole (72) can communicate with the high-pressure chamber (26*b*) of the compression chamber (26), as shown in FIG. 2.

A discharge valve (75) and a pressing plate (76) are tightly fixed at the front head (23) via the bolt (73) screwed into the tightening hole (74), as shown in FIGS. 3A and 5. The discharge valve (75) is a plate-like opening/closing valve for closing the upper end of the discharge hole (72). The discharge valve (75) is flexed to allow the discharge hole (72) to be opened, thereby leading to the communication of the inside of the compression chamber (26) with the inside of the casing (10) when a refrigerant pressure inside of the compression chamber (26) is increased up to substantially the same as the pressure inside of the casing (10). The pressing plate (76) is disposed above the discharge valve (75), thereby restricting a flexure quantity of the discharge valve (75) so as to prevent any excessive flexure of the discharge valve (75). Incidentally, the discharge valve (75), the pressing plate (76) and the bolt (73) are omitted in FIG. 3B.

Figure 6:
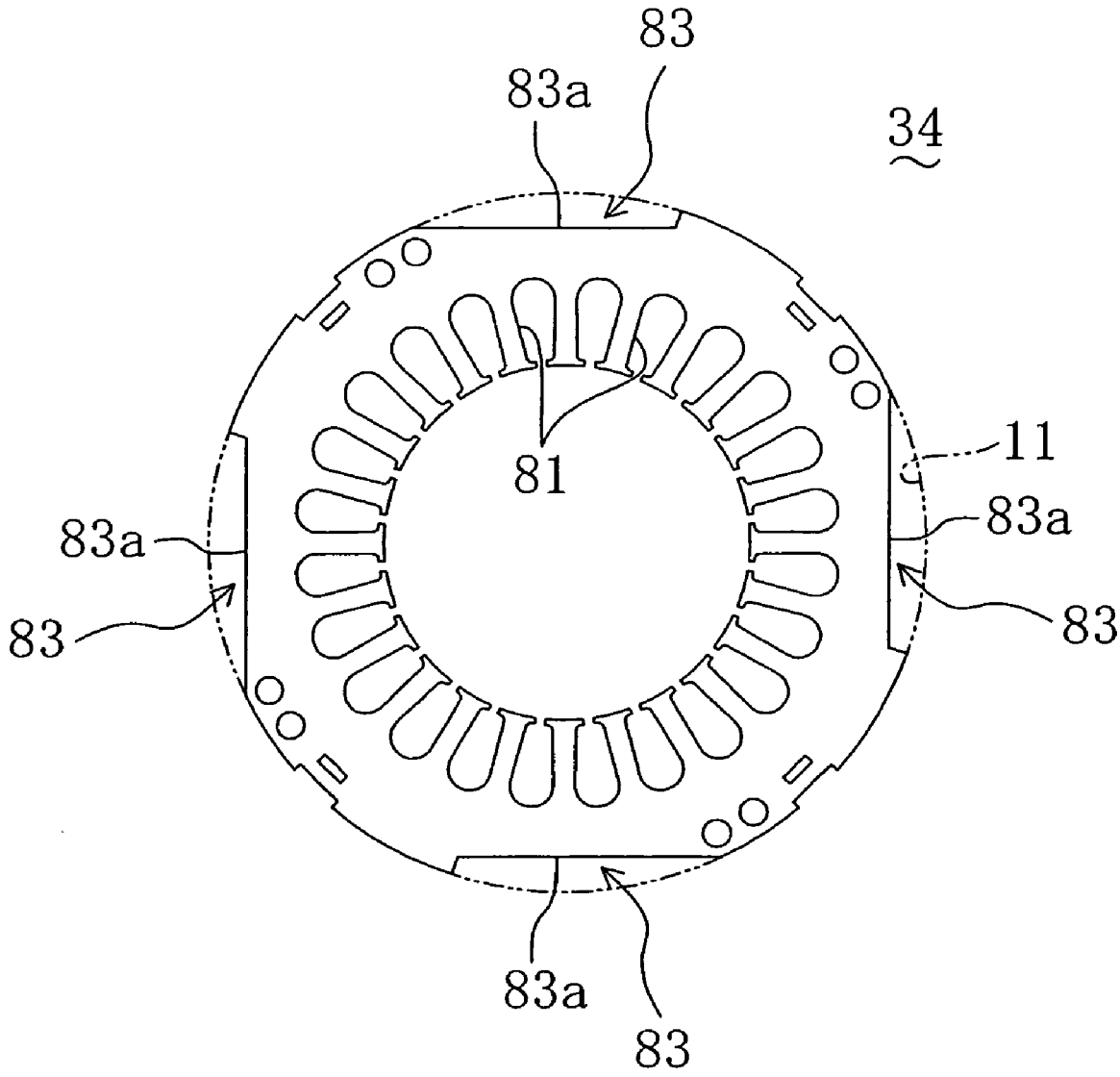
FIG. 6 is a plan view showing a stator core.

As shown in FIG. 6, the stator core (34) is formed into a cylindrical shape, and further, coil inserting portions (81) consisting of a plurality of recessed grooves extending in an axial direction of the drive shaft (31) are formed at equal intervals in the circumferential direction at the inner circumferential surface of the stator core (34). The number of coil inserting portions (81) is, for example, 24. Each of the three-phase coils is inserted into the coil inserting portions (81). In addition, core cut portions (83) serving as oil returning portions are formed at the outer peripheral surface of the stator core (34). The core cut portions (83) are arranged at equal intervals in the circumferential direction, and further, are constituted of a plurality of outer recess portions (83*a*) extending in the axial direction. The outer recess portions (83*a*) are formed at four points at an interval of 90° from the upper end of the stator core (34) toward the lower end thereof. The core cut portions (83) are provided as channels for the refrigerant and the lubricant inside of the casing (10). The area of each of the core cut portions (83) is set to 5% or more with respect to the bottom area of the inner surface of the casing (10). For example, the bottom area of the inner surface of the casing (10) is 9,852 $mm^2$, and therefore, the area of the core cut portions (83) is 951 $mm^2$.

Moreover, the outer peripheral surface of the stator core (34) is brought into contact with the inner circumferential surface of the drum (11) of the casing (10) at portions other than the core cut portions (83). The contact portions are fixed to the drum (11) by spot welding. In other words, the core cut portions (83) are formed adjacently to the portions in contact with the casing (10).

Subsequently, a description will be given of the operation of the hermetic sealed compressor (1) in the present embodiment.

When the electric power is supplied to the compressor motor (30) via the terminal (17), the rotor (33) is rotated, so that the rotation of the rotor (33) is transmitted to the swing (25) of the compressing element (20) via the drive shaft (31). Consequently, the compressing element (20) performs a predetermined compressing operation.

Specifically, explanation will be made on the compressing operation of the compressing element (20) in reference to FIG. 2. First, a description will be given of the state in which the cylinder body (22) and the swing (25) are brought into contact with each other immediately rightward of the inside opening end of the suction passage (64) formed in the cylinder body (22). In this state, the capacity of the low-pressure chamber (26*a*) of the compression chamber (26) becomes minimum. When the swing (25) is rotated clockwise by the drive of the compressor motor (30), the capacity of the low-pressure chamber (26*a*) is increased according to the rotation of the swing (25), so that the low-pressure refrigerant is sucked into the low-pressure chamber (26*a*). The low-pressure refrigerant flows from the refrigerant circuit to the accumulator (50), in which the liquid refrigerant is separated, and then, it flows through the suction pipe (15). The refrigerant is continuously sucked until the swing (25) revolves once so that the cylinder body (22) and the swing (25) are brought into contact with each other again immediately rightward of the inside opening end of the suction passage (64). At this time, the inner surface of the cylinder (21) and the swing (25) are covered with the oil film of the lubricant in the compression chamber (26), and therefore, the refrigerant contains therein the lubricant.

In this manner, the portion where the refrigerant has been sucked is the high-pressure chamber (26*b*) where the refrigerant will be compressed. The capacity of the high-pressure chamber (26*b*) is maximum at this time, and therefore, the high-pressure chamber (26*b*) is full of the low-pressure refrigerant. Since the inside pressure of the high-pressure chamber (26*b*) is low at this time, the discharge hole (72) of the front head (23) is closed by the discharge valve (75), so that the high-pressure chamber (26*b*) is a sealed space. The capacity of the high-pressure chamber (26*b*) is decreased as the swing (25) is rotated from this state, and thus, the refrigerant staying inside of the high-pressure chamber (26*b*) is compressed. When the pressure inside of the high-pressure chamber (26*b*) reaches a predetermined value, the discharge valve (75) is flexed by pressing by the high-pressure refrigerant staying inside of the high-pressure chamber (26*b*), thereby opening the discharge hole (72), so that the high-pressure refrigerant is discharged into the casing (10) from the high-pressure chamber (26*b*). At this time, the refrigerant is compressed above its critical pressure, and thus, the lubricant is discharged into the casing (10) together with the high-pressure refrigerant.

The casing (10) is full of the high-pressure refrigerant. The high-pressure refrigerant is discharged from the discharge pipe (16), and then, circulates in the refrigerant circuit, not shown. In the meantime, a part of the lubricant contained in the high-pressure refrigerant staying inside of the casing (10) adheres to the inner wall of the casing (10). The lubricant flows down along the inner wall of the casing (10), and then, flows between the outer recess portions (83*a*) in the stator core (34) and the casing (10), and finally, passes through the oil returning hole (47) or bottom recess (46) in the mounting plate (40). The lubricant passing through the oil returning hole (47) is reserved in the lower portion of the casing (10). In contrast, the lubricant passing through the bottom recess (46) flows into the back space (67) in the bush hole (65) in the cylinder body (22).

As described above, according to the hermetic sealed compressor (1) in the present embodiment, the fixing member for fixing the compressing element (20) to the casing (10) is constituted of the mounting plate (40), which is separate from the compressing element (20) and the casing (10), and further, the mounting plate (40) is made of steel containing 2.0% or less of carbon therein. Consequently, in the case where the casing (10) is deformed with an increase in inside pressure of the casing (10), it is possible to prevent any welding deficiency such as de-welding at the welding portion, for example, the welding portion of the casting. As a result, it is possible to enhance the reliability with respect to the welding in fixing the compressing element (20). Moreover, since the compressing element (20) is fixed to the casing (10) via the mounting plate (40), it is possible to enhance the reliability of the welding, by which the cylinder (21) made of the casting is fixed, like in the prior art.

Additionally, the mounting plate (40) is fixed to the casing (10) by welding; in contrast, the mounting plate (40) is tightly fixed to the front head (23) of the compressing element (20). Consequently, in the same cylinder (21) made of the casting as in the prior art, it is possible to enhance the reliability on fixing the mounting plate (40) to the casing (10) by welding, and further, to securely fix the cylinder (21) to the mounting plate (40).

In addition, the compressing element (20) includes the cylinder (21), the swing piston (25) and the bush (66). The bush hole (65) is formed in the cylinder (21). At the mounting plate (40) is formed the bottom recess (46) communicating with the bush hole (65). Consequently, it is possible to allow the lubricant staying inside of the casing (10) to readily flow into the bush hole (65) through the bottom recess (46). As a result, it is possible to allow the highly viscous lubricant to securely flow into the bush hole (65).

Furthermore, since the opening area of the oil returning hole (47) formed at the mounting plate (40) is set to 50% or more with respect to the bottom area of the mounting plate (40), it is possible to easily remove the lubricant remaining on the mounting plate (40). Consequently, it is possible to securely return the highly viscous lubricant to the oil reservoir.

Moreover, since the stator core (34) of the compressor motor (30) for driving the compressing element (20) is welded to the casing (10), it is possible to prevent any positional shift of the stator core (34) even if the casing (10) is expansively deformed by the increase in inside pressure. Additionally, it is possible to securely weld the stator core (34) made of steel to the casing (10). As a result, it is possible to prevent any degradation of the air gap between the stator core (34) and the rotor (33) or any contact of the stator core (34) with the rotor (33), thus enhancing the reliability of the compressor (1).

In addition, the mounting plate (40) and the stator core (34) are welded to each other via the welding holes (28) and (38), so that they can be securely welded to each other with ease.

Furthermore, since the core cut portions (83) are formed in the stator core (34), wherein the area of each of the core cut portions (83) is set to 5% or more with respect to the bottom area inside of the casing (10), the lubricant staying inside of the casing (10) can be readily returned to the oil reservoir through the core cut portions (83) formed in the stator core (34). Moreover, it is possible to securely return the highly viscous lubricant to the oil reservoir.

Additionally, since the core cut portions (83) in the stator core (34) are formed adjacently to the portions at which the stator core (34) is brought into contact with the casing (10), it is possible to secure the portion welded to the casing (10). In the meantime, it is possible to securely return the lubricant adhering to the inner wall of the casing (10) to the oil reservoir.

In addition, since the compressor (1) is configured in the high-pressure domed type such that the refrigerant discharged from the compressing element (20) is filled inside of the casing (10), it is possible to prevent any welding deficiency such as the de-welding or any positional shift of the stator core (34) even if the refrigerant, which is discharged at the increased pressure, is filled inside of the casing (10) so that the casing (10) is expansively deformed.

Furthermore, since the operating fluid is configured to be compressed above its critical pressure, the high pressure becomes very high inside of the hermetic sealed compressor (1). However, since the mounting plate (40) for fixing the compressing element (20) to the casing (10) is made of steel containing 2.0% or less of carbon therein, it is possible to prevent any welding deficiency such as the de-welding even if the inside pressure of the casing (10) becomes very high so that the casing (10) is expansively deformed. Moreover, since the stator core (34) is welded, it is possible to prevent any positional shift of the stator core (34) even if the inside pressure of the casing (10) becomes very high so that the casing (10) is expansively deformed.

OTHER PREFERRED EMBODIMENTS

Although in the above-described embodiment the cylinder (21) is fixed to the casing (10) via the mounting plate (40) separate from the cylinder (21), the configuration of the fixing member is not limited to the above-described configuration. In fact, it is sufficient that the compressing element (20) is fixed via the fixing member (40) which is made of steel containing 2.0% or less of carbon therein and is welded to the casing (10).

Otherwise, although in the above-described embodiment the mounting plate (40) is tightly fixed to the front head (23), the configuration is not limited to this. For example, the mounting plate (40) may be tightly fixed to the cylinder body (22) or the rear head (24).

Or, although in the above-described embodiment the compressing element (20) is constituted of the rotor (60) and the blade (61) of the swing (25) in the integral fashion, the configuration is not limited to this. In this case, the bottom recess (46) in the mounting plate (40) may be omitted.

Alternatively, if the highly viscous lubricant is not used in the above-described embodiment, the oil returning hole (47) in the mounting plate (40) may be omitted.

Otherwise, if the operating fluid whose high pressure becomes very high is not used in the above-described embodiment, the configuration in which the stator core (34) of the compressor motor (30) is welded to the casing (10) or the compressing element (20) is fixed via the mounting plate (40) may be omitted.

Or, the mounting plate (40) and the stator core (34) may not be welded via the welding holes (28) and (38) in the above-described embodiment.

Alternatively, if the highly viscous lubricant is not used in the above-described embodiment, the cutout area of the core cut portion (83) in the stator core (34) may be reduced.

Otherwise, the compressor in the above-described embodiment is not limited to the high-pressure dome type compressor (1).

INDUSTRIAL APPLICABILITY

As described above, the hermetic sealed compressor according to the present invention is useful in the case where the fluid having the very high pressure is compressed. In particular, the hermetic sealed compressor according to the present invention is applicable to the use in an air conditioner.

The invention claimed is:

1. A hermetic sealed compressor comprising:

a casing; and a compressing element configured to compress an operating fluid and accommodated inside the casing, the compressing element including a cylinder forming a bushing hole, a swing piston swinging in the cylinder, and a bushing inserted in the bushing hole and supporting the swing piston, the compressing element including a main body, a cover forming the upper surface of a compression chamber and a bottom forming the lower surface of the compression chamber, the compressing element being fixed to a fixing member which is made of steel containing 2.0% or less of carbon therein and welded to the casing, the fixing member being configured independently of the compressing element and the casing, the fixing member being welded to the casing while at least either of the cover or the bottom of the compressing element is tightly fixed to the fixing member, and the fixing member forming a bushing penetrating hole that communicates with the bushing hole and allows a lubricant in the casing to flow through the bushing hole.

2. The hermetic sealed compressor of claim 1, wherein the fixing member is formed into an annular shape in such a manner as to allow the compressing element to be fitted and inserted thereinto; and an oil returning hole for allowing the lubricant to flow down is formed in the fixing member, the opening area of the oil returning hole being set to 50% or more with respect to the bottom area of the fixing member.

3. The hermetic sealed compressor of claim 1, wherein a welding hole is formed in the casing in a manner corresponding to the fixing member; and the fixing member is welded to the casing via the welding hole.

4. The hermetic sealed compressor of claim 1, wherein the casing incorporates therein a drive motor provided with a stator having coils wound around a stator core and a rotor rotatably housed inside of the stator and drivingly connected to the compressing element, thus driving the compressing element, the stator core of the drive motor being welded to the casing.

5. The hermetic sealed compressor of claim 4, wherein a welding hole is formed in the casing in a manner corresponding to the stator core, the stator core being welded to the casing via the welding hole.

6. The hermetic sealed compressor of claim 4, wherein oil returning portions, each having an area of 5% or more with respect to a bottom area at the inside of the casing, are formed in the stator core.

7. The hermetic sealed compressor of claim 6, wherein the oil returning portions in the stator core are formed adjacently to portions at which the outer peripheral surface of the stator core is brought into contact with the casing.

8. The hermetic sealed compressor of claim 1, wherein the operating fluid discharged from the compressing element is configured in a high-pressure domed type in such a manner as to fill the inside of the casing.

9. The hermetic sealed compressor of claim 1, wherein the hermetic sealed compressor being connected to a refrigerant circuit for performing a freezing cycle and configured in such a manner as to compress the operating fluid above its critical pressure.

* * * * *